US008740311B2

(12) United States Patent
Nagasawa

(10) Patent No.: US 8,740,311 B2
(45) Date of Patent: Jun. 3, 2014

(54) CUTTING APPARATUS FOR CONCRETE OR THE LIKE

(75) Inventor: Kenichi Nagasawa, Hasuda (JP)

(73) Assignee: Mikasa Sangyo Co., Ltd., Tokyo (JP)

( * ) Notice: Subject to any disclaimer, the term of this patent is extended or adjusted under 35 U.S.C. 154(b) by 218 days.

(21) Appl. No.: 13/365,681

(22) Filed: Feb. 3, 2012

(65) Prior Publication Data

US 2012/0200140 A1 Aug. 9, 2012

(30) Foreign Application Priority Data

Feb. 8, 2011 (JP) ..... 2011-025027

(51) Int. Cl.
*E01C 23/09* (2006.01)

(52) U.S. Cl.
USPC ..... 299/39.3; 125/13.03

(58) Field of Classification Search
USPC ..... 299/39.3; 125/13.03
See application file for complete search history.

(56) References Cited

U.S. PATENT DOCUMENTS

| | | | | |
|---|---|---|---|---|
| 4,041,928 | A * | 8/1977 | Robinson | 125/13.03 |
| 5,452,943 | A * | 9/1995 | Campbell | 299/39.3 |
| 7,241,211 | B2 * | 7/2007 | Baratta | 299/39.3 |
| 8,413,645 | B2 * | 4/2013 | Donnerdal et al. | 125/13.01 |

FOREIGN PATENT DOCUMENTS

| | | |
|---|---|---|
| JP | 5-73010 U | 10/1993 |
| JP | 08-001655 A | 1/1996 |

* cited by examiner

*Primary Examiner* — John Kreck
(74) *Attorney, Agent, or Firm* — Holtz Holtz Goodman & Chick PC

(57) ABSTRACT

A cutting apparatus has a main body including a body frame, wheels, a motor and a blade; a blade cover; and a slide guide. A cutting depth of the blade is adjustable. A blade cover casing entirely covers the blade. A slider having left and right linear portions is attached to a rear surface of the casing. The slide guide has circular-arc portions and flaps for sandwiching the linear portions of the slider. A gap is formed between the flaps and a side surface of the body frame. By sandwiching the linear portions of the slider between a flap and the body frame, and sandwiching the circular-arc portions between the left and right linear portions, the blade cover can slide in the up-down direction with respect to the slide guide and the body frame and can rotate about the circular-arc portions.

15 Claims, 7 Drawing Sheets

(1)

(2)

CUTTING APPARATUS FOR CONCRETE OR THE LIKE

BACKGROUND OF THE INVENTION

1. Field of the Invention

The present invention relates to a cutting apparatus for concrete or the like used to break or cut a road pavement surface or concrete surface, and more particularly to a cutting apparatus for concrete or the like that features a holding structure of a blade cover that is attached to prevent dust such as cutting chips from scattering, and recover the dust.

2. Description of the Related Art

Where a road pavement surface or concrete is cut with a concrete cutter which is one of cutting apparatuses for concrete or the like, dust such as cutting chips is generated. This dust should be recovered as industrial waste. Therefore, some of the conventional concrete cutters are known to have a blade cover that is connected to a dust collection deice and attached around the blade, thereby making it possible to prevent dust generated by the cutting operation from scattering and suck in and recover the dust with the dust collection device.

In a concrete cutter used for cutting a road pavement surface, the body frame is typically supported by wheels (front wheels and rear wheels) and the concrete cutter is configured so that the inclination angle of the body frame in the front-rear direction and the height of the body frame on the front side can be changed. As a result, the cutting depth of the blade attached to the front portion of the body frame can be adjusted.

More specifically, in a concrete cutter 51 shown in FIG. 8, a body frame 52 is supported by a front wheel 53 and a rear wheel 54, and a blade 55 is attached to a side of a front portion 52*a* of the body frame 52. The blade 55 is attached to a distal end (protrudes toward the side of the body frame 52) of a rotating shaft 56 supported horizontally in the left-right direction of the body frame 52, and the blade is supported in a state such that a portion with a span of about 140 to 150° on the lower side of the blade tip protrudes below a bottom surface 52*b* of the body frame 52. The blade is configured to receive drive power from a motor (gasoline engine or the like; not shown in the figure) that is carried on the body frame 52 and rotates at a high speed.

The front wheel 53 is pivotally supported on a distal end of a support arm 57, and the support arm 57 is supported in a state in which a proximal end portion 57*a* thereof can rotate about a horizontal axis at an intermediate position in the front-rear direction of the body frame 52. By operating a cutting depth adjusting handle (not shown in the figure), it is possible to rotate the distal end side of the support arm 57 from a position shown in FIG. 8(1) to a position shown in FIG. 8(3). As a result, the inclination angle in the front-rear direction of the body frame 52 with respect to a central axis of a shaft 54*a* of the rear wheel 54 as a base point and the height of the front portion 52*a* of the body frame 52 (height from a cutting object surface G to a bottom surface 52*b* in the front portion 52*a*) can be changed.

The following problem is encountered when a blade cover is attached to the concrete cutter 51, such as shown in FIG. 8, in which the cutting depth of the blade 55 is adjusted by changing the inclination angle of the body frame 52 in the front-rear direction.

When the air under the blade cover is to be sucked in with the dust collection device in order to recover the dust, the blade cover should be held at all times so that the lower edge of the blade cover is at a position close to the cutting object surface G, regardless of the cutting depth of the blade 55. For this reason, the blade cover should be attached to the body frame 52 so that the blade cover could be moved in the upon-down direction.

Accordingly, some of the conventional concrete cutters are configured such that a slide guide with a side edge extending in the vertical direction is attached to the body frame 52 and a bracket capable of sliding along both side edges of the slide guide is attached to the blade cover, thereby making it possible to move the blade cover in the up-down direction.

However, in the concrete cutter of such a type, where the tilting angle of the body frame 52 in the front-rear direction is changed to adjust the cutting depth, the tilting angles of both the body frame 52 and the blade cover change and therefore the lower edge of the blade cover cannot be held in the horizontal state (state in which the lower edge is parallel to the cutting object surface G) and a large gap can be formed between the blade cover and the cutting object surface G due to the inclination angle of the body frame 52. In such a case, the object of preventing dust from scattering and performing suction and recover of dust with the dust collection device cannot be attained.

Some of the conventional concrete cutters are configured with a slide guide supporting the blade cover so that the blade cover can move in the up-down direction with respect to the body frame 52, thereby making it possible to maintain the lower edge of the blade cover parallel to the cutting object surface G at all times, even when the tilting angle of the body frame 52 is changed. However, the durability problem arising in this case is that structural components (pivotal fitting section or link mechanism) can be easily damaged by vibrations occurring during the cutting operation or the like. Another problem is that the structural components should be periodically lubricated, but the dust can easily adhere to the lubricant and the maintenance becomes difficult.

SUMMARY OF THE INVENTION

The present invention has been created to resolve the above-described problems inherent to the prior art and it is an object of the present invention to provide a cutting apparatus for concrete or the like, in which the blade cover can be held horizontally at all times and dust can be advantageously recovered even when the tilting angle of the body frame is changed, despite its simple configuration.

The cutting apparatus for concrete or the like in accordance with the present invention includes: a main body; a blade cover; and a slide guide, wherein the main body includes a body frame, wheels, a motor, a blade, and a dust collection device and is configured so that a cutting depth of the blade during a cutting operation can be adjusted by changing a tilting angle of the body frame in a front-rear direction and a height of a front portion of the body frame; the blade cover is includes a box-shaped casing formed to have a size such that the blade can be entirely covered and a slider attached to a rear surface of the casing; the casing is open at a bottom surface side, and a notch for receiving a rotating shaft of the blade is formed in the rear surface of the casing from a lower edge upward to a predetermined height position; the slider has a pair of left and right linear portions of a predetermined length and is attached so that both of the linear portions are oriented to be on an inner side and parallel to each other and also so that a predetermined gap is formed between a portion of a predetermined range including at least the linear portions and the rear surface of the casing; the slide guide is includes a pair of left and right circular-arc portions and flaps for sandwiching the linear portions of the slider; the circular-arc portions are disposed at a side surface of the body frame in a mutual arrangement so as to face one another in a front-rear direction of the body frame, with a rotating shaft that supports the blade being inserted therebetween; the flap is attached so that a predetermined gap is formed between the flap and the side surface of the body frame; and by sandwiching the linear portions of the slider between the flap of the slide guide and the body frame and sandwiching the circular-arc portions between the pair of left and right linear portions, the blade cover is held in a state in which the blade cover can slide in the up-down direction with respect to the slide guide and the body frame and can rotate about the circular-arc portions.

It is preferred that the pair of left and right circular-arc portions be curved along a single virtual circle, and it is preferred that the slider be attached to the rear surface of the casing, with vibration-damping rubber bushing being interposed therebetween, and the entire slider be fixed at a position separated from the casing. Further, it is preferred that an upper half of the blade cover be formed in a semicircular shape, and a base end portion of a dust flow channel formed inside the casing be open along an ejection direction of dust generated during the cutting operation.

It is also preferred that a dust guide be attached at a position such that part of the bottom surface of the blade cover be covered from below, so that a rear side could rotate, with a front side serving as a base point, and in a state such that the rear side is impelled downward. Further, it is preferred that a stopper that restricts at a certain height position a downward movement of the blade cover attached to the slide guide be attached to the rear surface of the casing.

In the cutting device for concrete or the like in accordance with the present invention, even when the tilting angle of the body frame is changed in the front-rear direction in order to adjust the cutting depth, the lower edge of the blade cover can be held at all times in the horizontal state (state parallel to the cutting object surface). Therefore, scattering of dust generated by the cutting operation can be prevented and the dust can be advantageous sucked in and recovered by the dust collection device. Further, this operation can be realized with a simple configuration, sufficient resistance to vibrations can be expected, lubrication is unnecessary, and adhesion of dust to the lubricant can be avoided. Therefore, it can be expected that complex maintenance operations can omitted.

BRIEF DESCRIPTION OF THE DRAWINGS

FIG. 1(1) is a front view thereof; FIG. 1(2) is a rear view thereof; and FIG. 1(3) is a plan view thereof;

DESCRIPTION OF THE PREFERRED EMBODIMENTS

An embodiment of the "cutting apparatus for concrete or the like" in accordance with the present invention is explained below. A configuration example relating to the case in which the present invention is applied to a "concrete cutter" is explained as an embodiment of the present invention. This concrete cutter is constituted by a blade cover of a specific structure and also a pair of left and right slide guides and a main body provided with typical elements (body frame, wheels, motor, blade, dust collection device, etc.) of a concrete cutter used for cutting a road pavement surface and the like.

Figure 8:
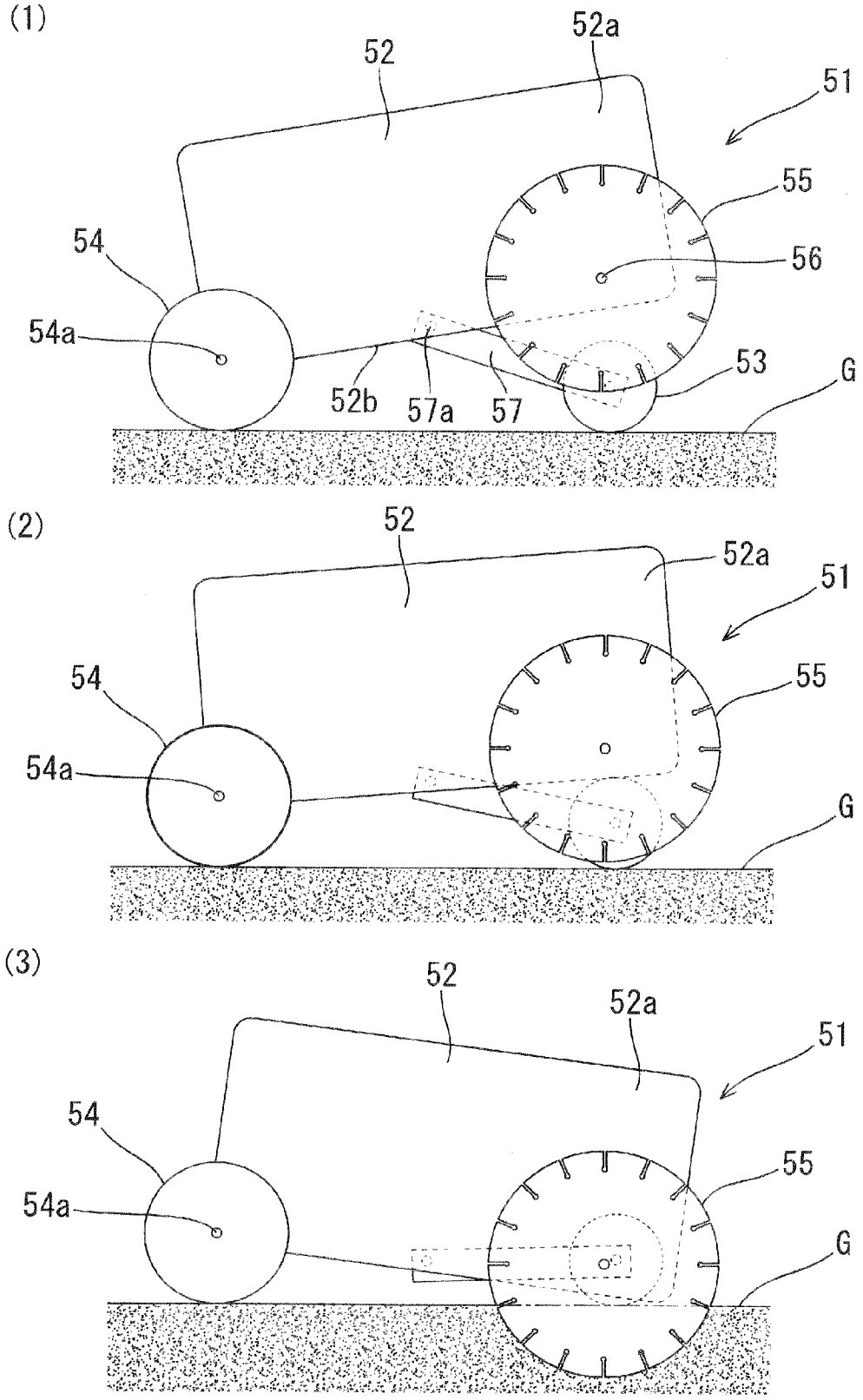
FIG. 8 illustrates the components and operation mode of the concrete cutter 51 of a type in which the cutting depth of the blade 55 is adjusted by changing the tilting angle of the body frame 52 in the front-rear direction.

Among these components, the body of the concrete cutter is configured similarly to that of the concrete cutter 51 shown in FIG. 8 and explained as the conventional concrete cutter. Thus, a body frame (52) is supported by a front wheel (53) and a rear wheel (54), and a blade (55) is attached to a left side (on the left side with respect to the direction from the front side to the rear side of the body frame) of a front portion (52*a*) of the body frame (52).

The blade (55) is pivotally supported at a distal end (protrudes toward the left side of the body frame (52)) of a rotating shaft (56) supported horizontally in the left-right direction of the body frame (52) and in a state such that a portion with a span of about 150° on the lower side of the blade tip protrudes below a bottom surface (52*b*) of the body frame (52). The blade is configured to receive drive power from a motor (gasoline engine or the like) that is carried on the body frame (52) and rotates at a high speed.

The front wheel (53) is pivotally supported on a distal end of a support arm (57). By operating a cutting depth adjusting handle, it is possible to rotate the distal end side of the support arm within a predetermined angle range. As a result, the inclination angle in the front-rear direction of the body frame (52) with respect to a central axis of a shaft (54*a*) of the rear wheel (54) as a base point and the height of the front portion (52*a*) of the body frame (52) can be changed and the cutting depth of the blade during the cutting operation can be adjusted.

Figure 1:
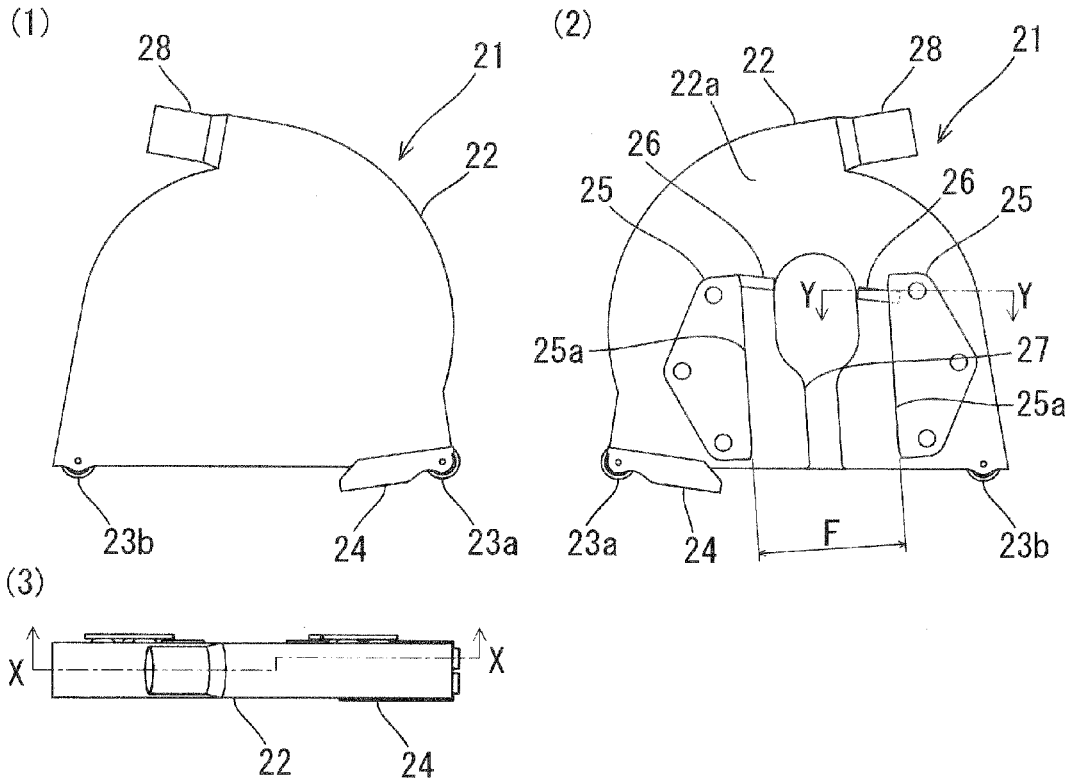
FIG. 1 illustrates the external shape of the blade cover 21 of the concrete cutter of the first embodiment of the present invention.
Figure 2:
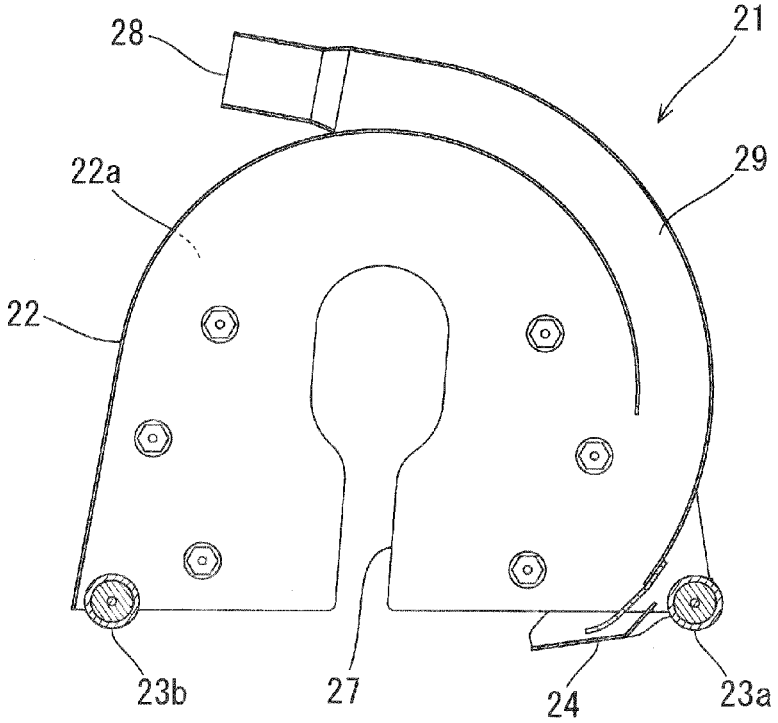
FIG. 2 is a vertical sectional view of the blade cover 21 taken along the X-X line in FIG. 1(3)

FIG. 1 illustrates the external shape of the blade cover 21 of the concrete cutter of the present embodiment. FIG. 1(1) is a front view thereof. FIG. 1(2) is a rear view thereof. FIG. 1(3) is a plan view thereof. FIG. 2 is a vertical sectional view of the blade cover 21 taken along the X-X line in FIG. 1(3). When the blade cover 21 is mounted on the main body of the concrete cutter, the left side in FIGS. 1(1), 1(3), and 2 is the front side of the concrete cutter main body, and the left side in the figures is the rear side of the concrete cutter main body. In FIG. 1(2), the arrangement is reversed.

As shown in the figures, the blade cover 21 is constituted by a casing 22, a caster 23 (a front caster 23*a* and a rear caster 23*b*), a dust guide 24, a pair of left and right sliders 25, and stoppers 26.

The casing 22 is formed by machining a thin metal sheet to a size such that the entire blade of the concrete cutter can be covered, and configured to be substantially box-shaped so as to form a closed space with respect to the outside so as to prevent the scattering of dust generated around the blade during the cutting operation, but the bottom surface side thereof is open. A notch 27 for receiving the rotating shaft of the blade when the casing is mounted around the blade is formed in the rear surface 22*a* (see FIG. 1(2)) from the lower edge upward (to the vicinity of the central portion of the casing 22).

A connector 28 to which a dust pipe (not shown in the figure) can be attached is mounted on top of the casing 22. The connector 28 communicates with the inner space of the casing 22 via a dust flow channel 29 formed in a circular-arc shape inside the casing 22, and the connector 28 and a dust collection device (not shown in the figure) are connected by a dust pipe, thereby making it possible to cause the dust generated inside the casing 22 to flow down toward the dust collection device via the dust flow channel 29 and the dust pipe and be recovered.

The casters 23*a*, 23*b* are attached so that when the blade cover 21 is mounted around the blade, the casters could freely rotate at positions in which the casters do not interfere with the blade (front end and rear end of the lower portion of the blade cover 21).

The dust guide 24 is formed such that dust jetted out in the tangential direction of the blade chip during the cutting operation is prevented from flying to the outside of the blade cover 21 from a fine gap between the lower edge of the blade cover 21 and the cutting object surface. The dust guide is constituted by a first dust guide 24*a* composed of a bottom surface portion and two side surface portions and a second dust guide 24*b*.

The first dust guide 24*a* is attached at a position such that the two side surface portions are arranged along the respective side surfaces of the blade cover 21 and also at a position such that the bottom surface portion covers from below a portion of the bottom surface of the blade cover 21. The second dust guide 24*b* is constituted by a flexible metal sheet having a width from the inner side surface at one side of the blade cover to the inner side surface at the opposite side and attached to the lower end of the dust flow channel 29.

End portions on the front side of the two side surface portions are pivotally attached to the shaft of the front caster 23*a*, and the first dust guide 24*a* (the rear side, with respect to the front side as a reference point) can rotate coaxially with the caster 23*a* within a predetermined angle range. However, in the first dust guide 24*a*, the rear side is impelled downward by the second dust guide 24*b* attached to the lower end of the dust flow channel 29. A notched groove for receiving the approaching blade is formed in the bottom surface portion of the first dust guide 24*a*.

The sliders 25 are obtained by machining a metal sheet with a thickness of 3.2 mm to a shape such as shown in FIG. 1(2). The sliders 25 each have a linear portion 25*a* of a predetermined length and attached to the bottom surface 22*a* of the casing 22 so that these linear portions 25*a* are both oriented to be on the inner side (on the notch 27 side) and have a mutual arrangement such as to face one another in the left-right direction, with the notch 27 being interposed therebetween. Further, the sliders 25 are attached at angles such that the linear portions 25*a* are parallel to each other and at angles such that the linear portions 25*a* are within a range of a vertical ±15° in the case in which the blade cover 21 is placed on a horizontal plane.

Figure 3:
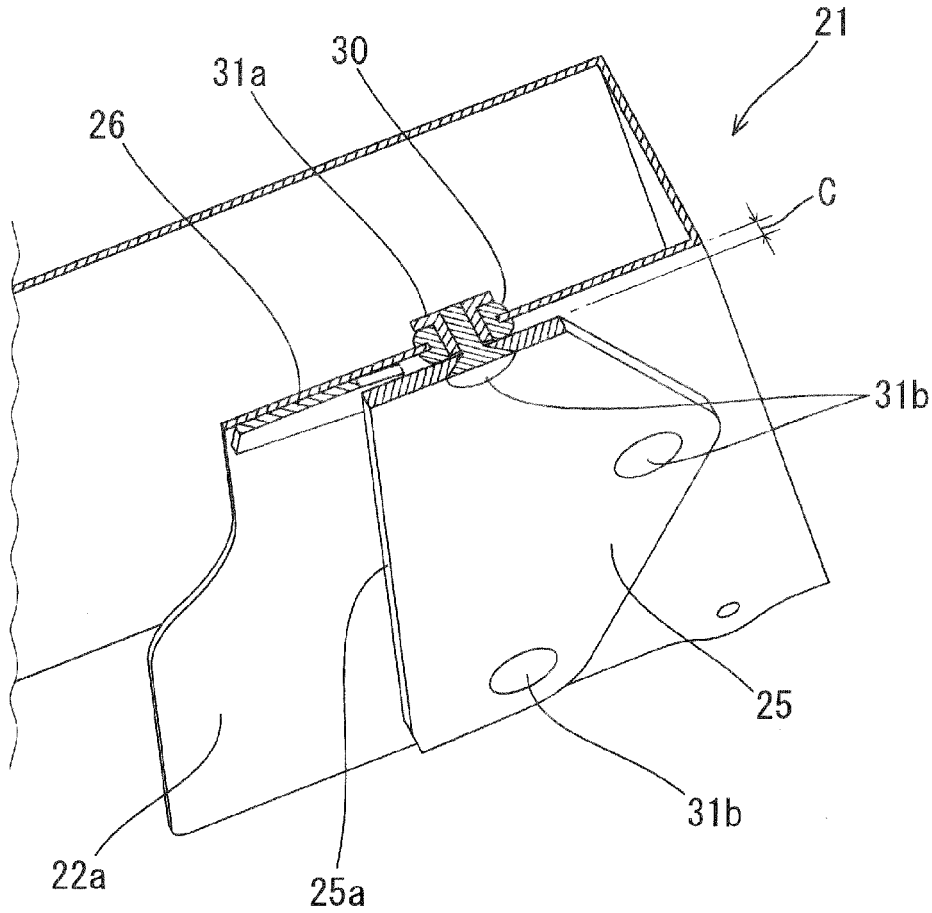
FIG. 3 is a perspective view of a partial horizontal cross section of the blade cover 21 taken along the Y-Y line in FIG. 1(2)

As shown in FIG. 3 (perspective view of a horizontal cross section of the blade cover 21 taken along the Y-Y line in FIG. 1(2)), the sliders 25 are fixed at positions at a predetermined distance toward the outside from the rear surface 22*a* of the casing 22. In other words, a gap C of a predetermined size (in the present embodiment, 4.5 mm) is formed between the sliders 25 and the rear surface 22*a* of the casing 22. In the present embodiment, the sliders 25 are fixed to the casing 22 by placing therebetween a plurality (three for each slider 25) of rubber bushings 30 (vibration dampers) with the same protrusion dimension from the rear surface 22*a* of the casing 22, so that the gap C be formed between the sliders 25 and the rear surface 22*a* of the casing 22.

More specifically, through holes are formed at predetermined positions (three locations for each slider 25) in the rear surface 22*a* of the casing 22, the rubber bushings 30 (ring-shaped rubber bushings with a shape of cross section passing through a central axis such as shown in FIG. 3) are fitted into the respective through holes, and a pair of fastening fixing members 31 (an insert collar 31*a* and a plate screw 31*b*) are fitted into the central holes of these rubber bushings 30, thereby attaching the sliders 25 to the casing 22 (the insert collar 31*a* is inserted from the inner side of the casing 22, and the plate screw 31*b* is screwed from the outer side of the slider 25 into the central hole of the insert collar 31*a* through the through hole of the slider 25).

The rubber bushings 30 used in this configuration area all of the same size and same shape, and where the rubber bushings are fitted into the through holes formed in the rear surface 22*a*, the portions protruding from the rear surface 22*a* toward the outside are all of the same size. Therefore, the gap C formed between the rear surface 22*a* and the sliders 25 fixed to the casing, with the rubber bushings 30 being interposed therebetween, has the same and predetermined size as measured from the rear surface 22*a*. Since the sliders 25 are thus fixed to the casing 22, with the rubber bushings 30 having a vibration damping function being interposed therebetween, when the blade cover 21 is attached to the main body of the concrete cutter, vibrations transmitted from the main body side (motor, blade, etc.) to the blade cover 21 can be advantageously attenuated.

In the present embodiment, as described hereinabove, the sliders 25 are fixed at position such as to be entirely separated from the casing 22, but the sliders 25 need not be necessarily entirely separated from the casing 22, and only a portion in a predetermined range including the linear portions 25*a* be fixed to a position separated to the outside from the rear surface 22*a* of the casing 22 so that a predetermined gap be formed therebetween (the gas of a size such that that the below-described slide guide could be inserted therein). However, in this case, a significant damping effect of vibrations transmitted from the main body side cannot be expected.

The stoppers 26 are obtained by welding and fixing metal plates having a predetermined thickness to the rear surface 22*a* and disposed at positioned between the upper portion of the sliders 25 and the notch 27.

Figure 4:
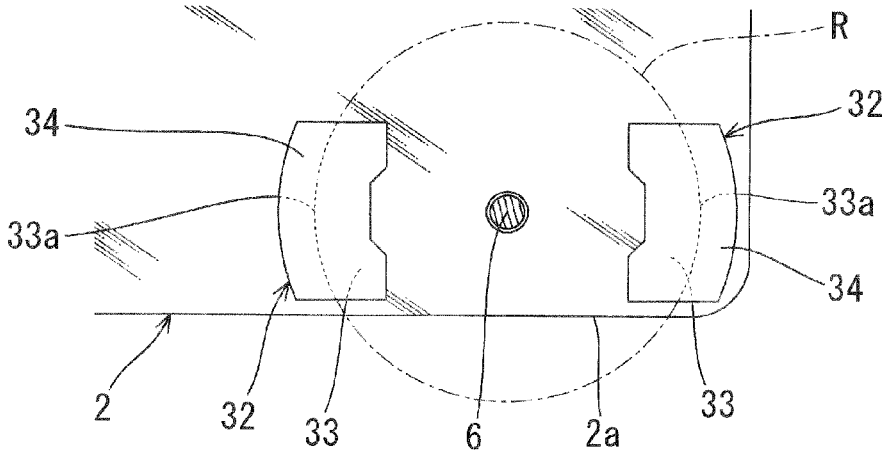
FIG. 4 illustrates the external shape of the slide guide 32 of the concrete cutter according to the first embodiment of the present invention.
Figure 4:
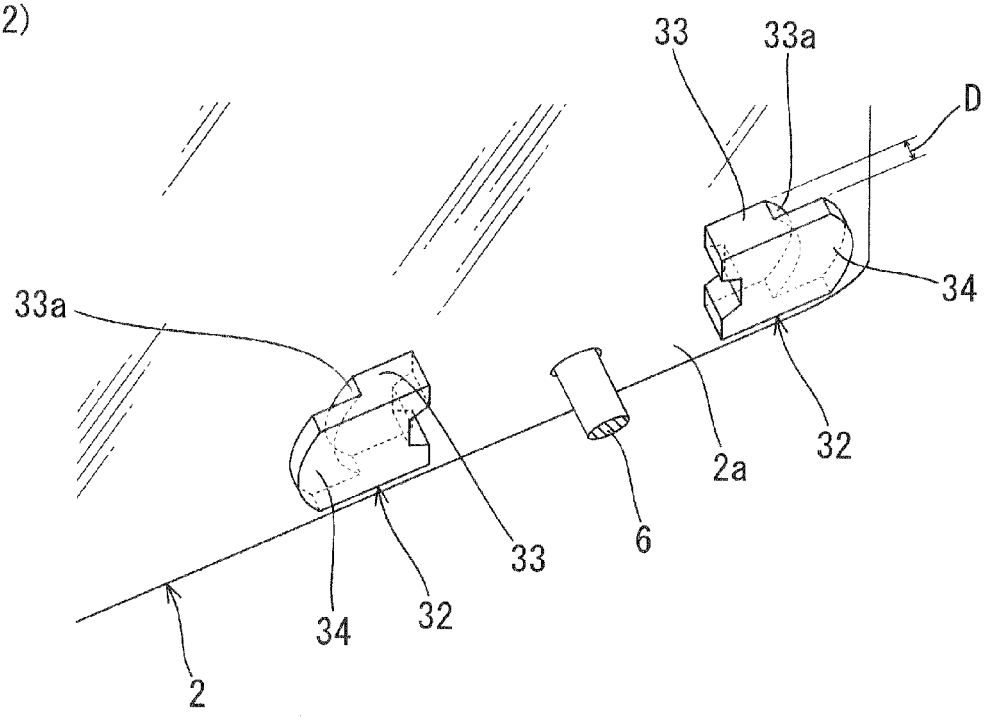

FIG. 4 illustrates the external shape of the slide guides 32 constituting the concrete cutter in accordance with the present invention. FIG. 4(1) illustrates the state in which the slide guides 32 are attached to the left side surface (side surface that is on the left side with respect to the direction from the front side to the rear side of the body frame 2) of the front portion 2*a* of the body frame 2, this state being viewed from a view point on the left side of the body frame 2. FIG. 4(2) is a perspective view of such a configuration. The slide guides 32 serve to hold the blade cover 21 shown in FIGS. 1 to 3 in a state such that the blade cover can be moved in the up-down direction with respect to the body frame 2 and so that the blade cover can be rotated about the rotating shaft 6.

As shown in these figures, the slide guides 32 are attached below the side surface (left side surface) of the front portion 2*a* of the body frame 2. The rotating shaft 6 that rotatably supports the blade (not shown in the figures) protrudes from the side surface of the front portion 2*a*, and the slide guides 32 are disposed with a mutual arrangement such as to face one another in the front-rear direction of the body frame 2, with the rotating shaft 6 being inserted therebetween.

Each of the slide guides 32 is constituted by a base 33 and a flap 34, and each base 33 has a circular-arc portion 33*a*. In the circular-arc portion 33*a*, one side surface of the base 33 is curved in a circular-arc shape centered on the rotating shaft 6, and the circular arc portion has a predetermined thickness (in the present embodiment, 4.5 mm) in the protrusion direction of the rotating shaft 6. The two circular-arc portions 33*a* are curved along a single virtual circle R (see FIG. 4(1)) centered on the rotating shaft 6, and a separation distance F (see FIG. 1(2)) between the linear portions 25*a* of the sliders 25 attached to the blade cover 21 is set to be substantially equal to the diameter of the virtual circle R.

The flap 34 is formed at a position at a predetermined distance in the sidewise direction from the body frame 2 (from the side surface of the front portion 2*a*), this distance being equal to the thickness of the circular-arc portion 33*a*, and protrudes radially outward of the circular-arc portion 33*a* from the edge on the outer side of the circular-arc portion 33*a*. In other words, a gap D of a predetermined size (in the present embodiment, 4.5 mm) is formed between the flap 34 and the side surface of the front portion 2*a*.

When the blade cover 21 (see FIGS. 1 to 3) is attached to the body frame 2, the linear portions 25*a* of the sliders 25 shown in FIGS. 1(2) and 3 are advanced from respective lower end sides into the gaps D (gaps between the flaps 34 and the side surface of the front portion 2*a*) of the slide guides 32 shown in FIG. 4(2). The linear portions 25*a* of the sliders 25 are thus sandwiched by the flaps 34 and the side surface of the front portion 2*a*. As a result, movement of the blade cover 21 sidewise of the body frame 2 (protrusion direction of the rotating shaft 6) is restricted.

As described hereinabove, the separation dimension F between the linear portions 25*a* of the sliders 25 (see FIG. 1(2)) is set to be substantially equal to the diameter of the virtual circle R (see FIG. 4(1) having the same trajectory as the circular-arc portions 33*a* of the slide guides 32. Therefore, where the linear portions 25*a* of the sliders 25 are advanced from the loser edge side between the flaps 34 of the slide guides 32 and the side surface of the front portion 2*a*, the circular-arc portions 33*a* are sandwiched by the two linear portions 25*a*, movement of the blade cover 21 in the front-rear direction of the body frame 2 is restricted, and a state is assumed in which the blade cover 21 can rotate about the circular-arc portions 33*a* within a predetermined angle range centered on the rotating shaft 6.

Further, since the linear portions 25*a* of the sliders 25 are parallel to one another, as mentioned hereinabove, and the separation dimension F (see FIG. 1(2)) between the linear portions 25*a* is fixed, a state is assumed in which the blade cover 21 can slide in the up-down direction with respect to the slide guides 32 and the body frame.

Figure 5:
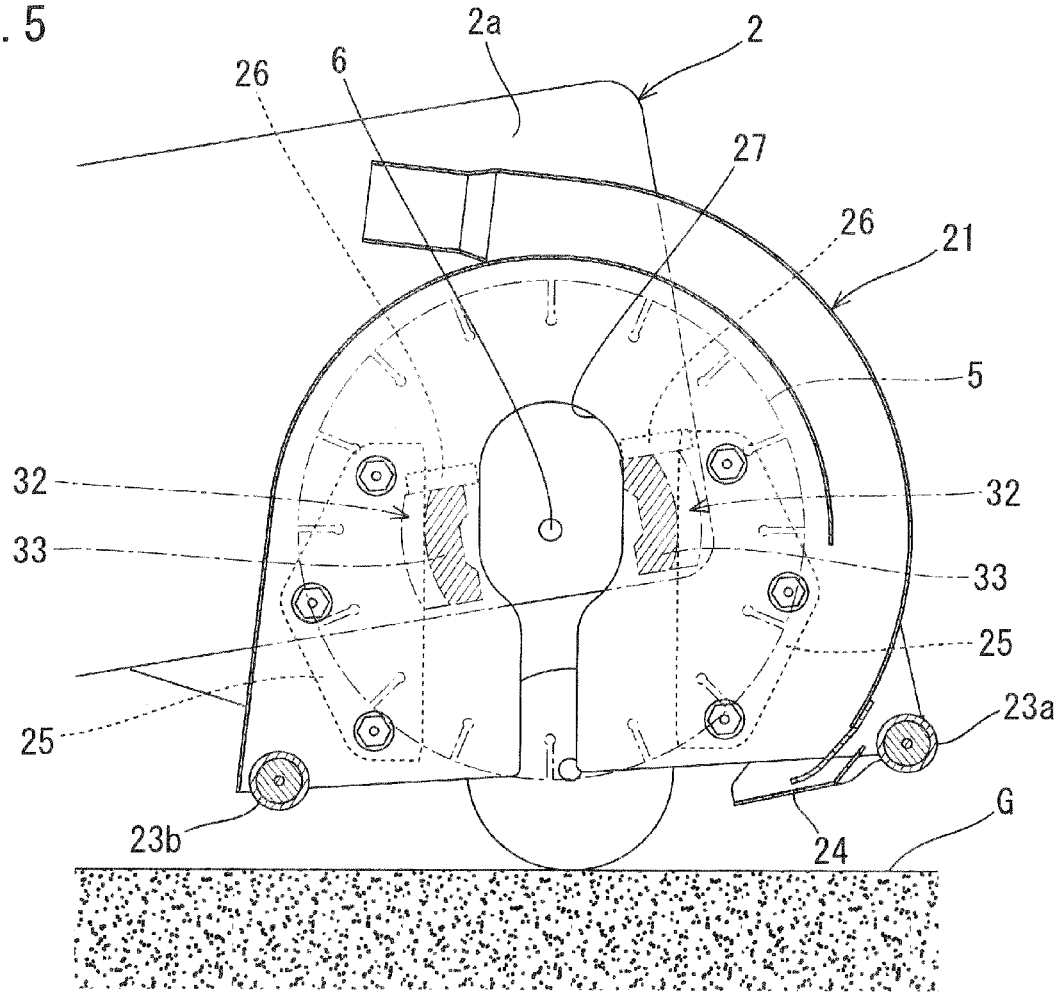
FIG. 5 is a vertical sectional view of the blade cover 21 attached to the body frame 2 of the concrete cutter according to the first embodiment of the present invention.

FIG. 5 is a vertical sectional view of the blade cover 21 attached to the body frame 2. In the figure, the sliders 25 and stoppers 26 attached to the rear surface of the blade cover 21 are shown by broken lines, and the slide guides 32 attached to the side surface of the front portion 2*a* of the body frame 2 and the blade 5 rotatably supported by the rotating shaft 6 are shown by dot-dash lines. The bases 33, 33 of the slide guides 32 are hatched to define clearly the boundaries with other elements.

As shown in FIG. 5, where the blade cover 21 is attached to the body frame 2 (where the sliders 25 are advanced from the lower end side into the gaps D (see FIG. 4(2)) of the slide guides 32) in a state in which the body frame 2 is tilted to the rear side and the front portion 2*a* is at the highest portions with respect to the ground surface (cutting object G), the blade cover 21 slides down under gravity, and the slide guides 32 slide toward the upper region (regions close to the top portions of the sliders 25), from among the region between the sliders 25.

However, the stoppers 26 that restrict the downward movement of the blade cover 21 (upward movement of the slide guides 32 in the region between the sliders 25) at a certain height position (position at which the blade cover 21 is not in contact with the blade 5) are disposed between the upper portions of the sliders 25 and the notch 27, and where the slide guides 32 abut on the stoppers 26, the blade cover 21 does not further descend and is held in a posture such as shown in FIG. 5 at the side of the body frame 2.

When the cutting operation is performed with respect to a road pavement or the like (cutting object surface G) by using the concrete cutter of the present embodiment, the inclination angel of the body frame 2 is gradually decreased from the state shown in FIG. 5 and the front portion 2*a* is brought close to the cutting object surface G by operating the cutting depth adjusting handle (not shown in the figure). As a result, at a certain point of time, the casters 23*a*, 23*b* of the blade cover 21 come into contact with the cutting object surface G as shown in FIG. 6.

Figure 6:
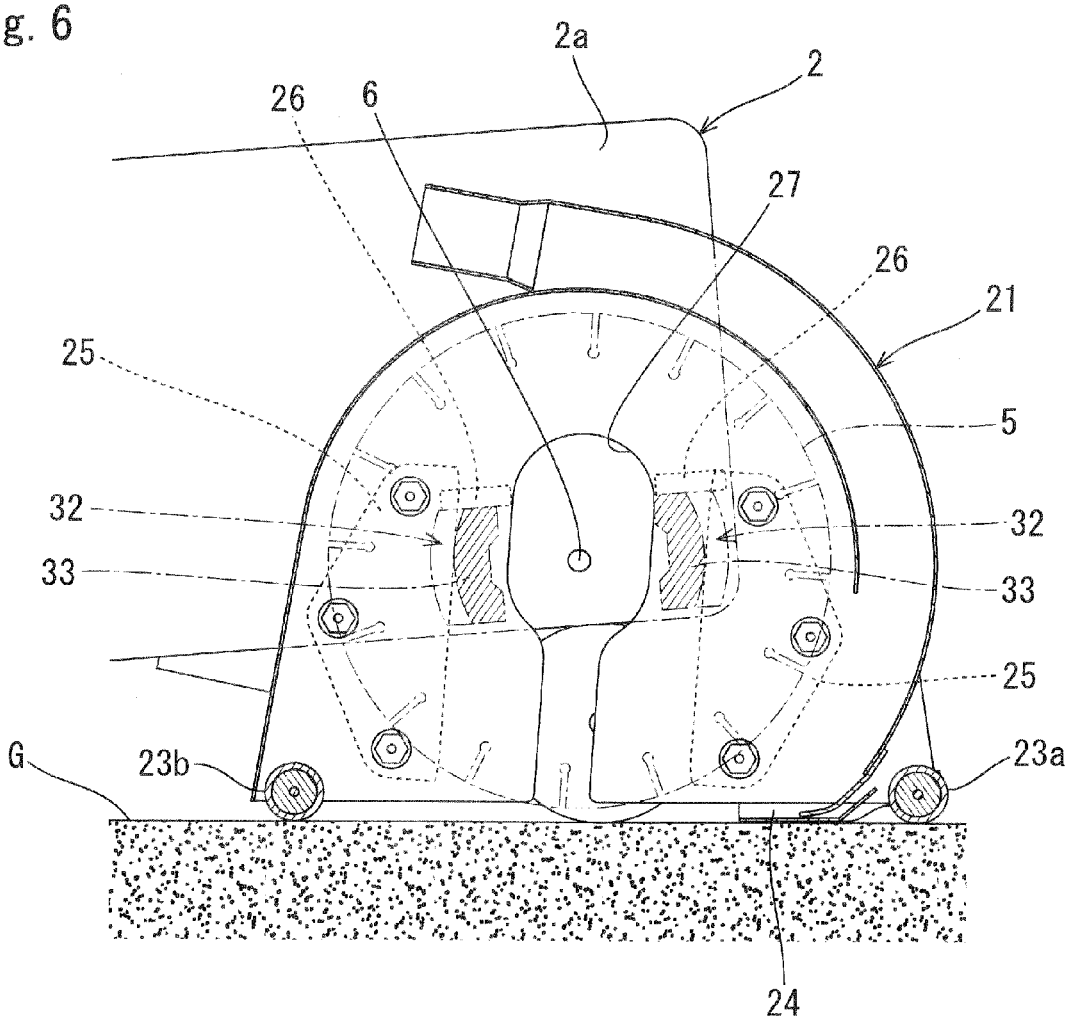
FIG. 6 is a vertical sectional view of the blade cover 21 in a state (position immediately prior to cutting) of attachment to the body frame 2 of the concrete cutter according to the first embodiment of the present invention.

Within the period of transition from the state shown in FIG. 5 to the state shown in FIG. 6, the slide guides 32 abut on the stoppers 26, and the blade cover 21 is suspended from the body frame 2, but as the front portion 2*a* is further bought closer the cutting object surface G from the position shown in FIG. 6 (position immediately prior to cutting), the slide guides 32 are separated from the stoppers 26 and move (slide) downward between the sliders 25.

Figure 7:
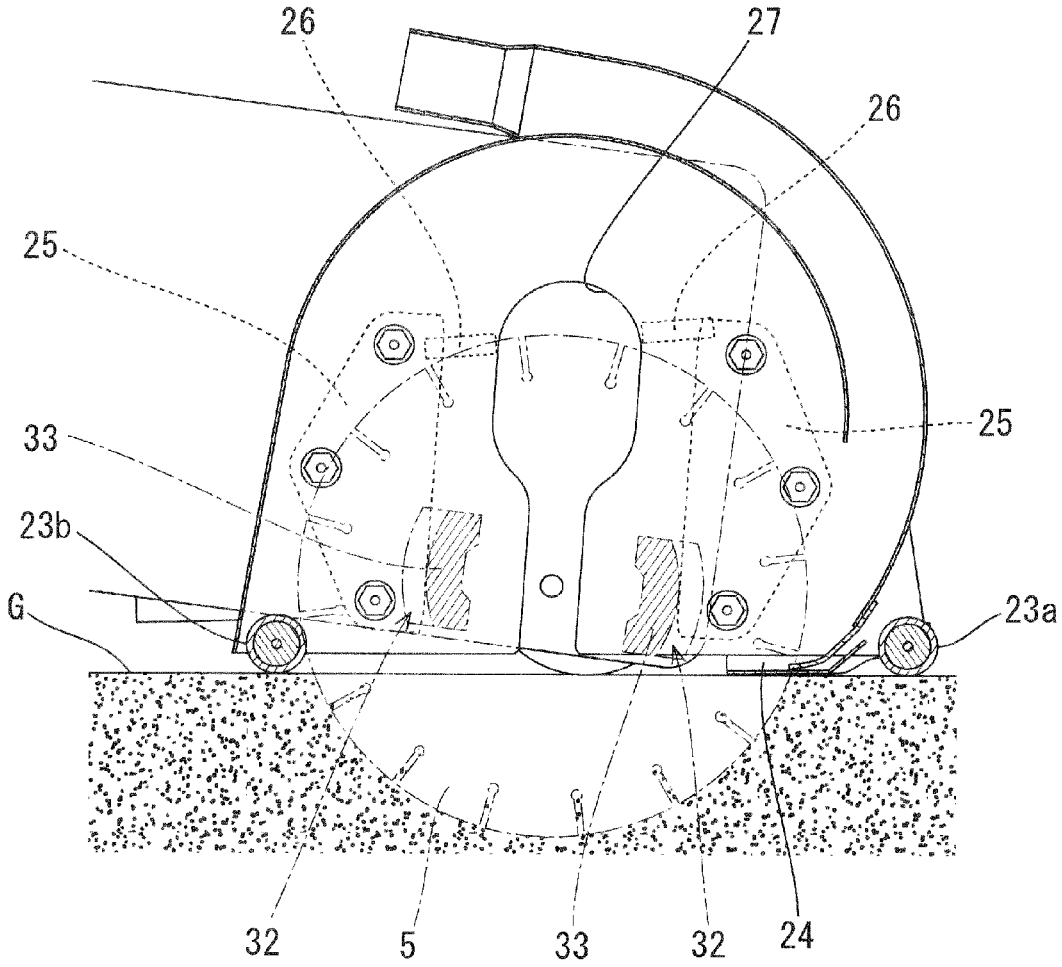
FIG. 7 is a vertical sectional view of the blade cover 21 in a state (deepest position of cutting) of attachment to the body frame 2 of the concrete cutter according to the first embodiment of the present invention.

The cutting is started when the lower edge of the blade 5 is brought into contact with the cutting object surface G in a state in which the blade 5 rotates at a high speed in a predetermined direction (direction in which the lower edge side of the blade 5 moves from the rear side toward the front side of the body frame 2; counterclockwise direction in FIGS. 5 and 6), and the object surface eventually can be cut to the depth position (deepest position of cutting) shown in FIG. 7.

In the course of transition from the position immediately prior to cutting that is shown in FIG. 6 to the deepest position of cutting shown in FIG. 7, the body frame 2 rotates (more specifically, the front portion 2*a* rotates from the position that is higher than the cutting object surface G by the protrusion height of the blade 5 to the position close to the cutting object surface G) about the rear wheel (not shown in the figure), and in this case, the inclination angle of the slide guide 32 holding the blade cover 21 is also changed.

However, since the blade cover 21 is held in a state in which the blade cover can rotate about the circular-art portions 33*a* of the slide guides 32, with the rotating shaft 6 being the rotation center, even in the case in which the inclination angel of the body frame 2 and the slide guides 32 has been changed, the horizontal state (both the front caster 23*a* and the rear caster 23*b* are in contact with the cutting object surface G, and the lower edge of the blade cover 21 is parallel to the cutting object surface G) is maintained.

Therefore, the problem associated with the convention technology, that is, the formation of a large gap between the lower edge of the blade cover and the cutting object surface that follows the change in the tilting angle of the body frame, can be advantageously avoided, scattering of dust generated by the cutting operation can be prevented and the dust can be advantageously sucked in and recovered by a dust collection device.

Further, since the rotation of the blade cover 21 with respect to the body frame 2 and the movement of the blade cover in the up-down direction can be realized by using very simple components, without introducing a pivotal fitting section or link mechanism, sufficient resistance to vibrations can be expected, lubrication is unnecessary, and adhesion of dust to the lubricant can be avoided. Therefore, it can be expected that complex maintenance operations could be omitted.

Further, as shown in FIG. 2, the upper half of the blade cover 21 of the present embodiment is formed in semicircular shape and the base end portion of the dust flow channel 29 is open along the ejection direction (tangential direction of the blade in the vicinity of the cutting object surface) of dust generated during the cutting operation. Therefore, where the air is sucked under the blade cover 21 by the dust collection device, a swirling flow occurs inside the glade cover 21, and the dust located inside the blade cover 21 can be sucked in and recovered very smoothly and efficiently.

In the present embodiment, the dust guide 24 that is impelled downward at the rear side thereof is disposed at a position in which dust is ejected from the cutting object surface during the cutting operation, and at the time of cutting, the rear side of the bottom surface portion of the dust guide 24 is at all times in contact with the cutting object surface. Therefore, in particular at the initial stage of cutting, dust can be advantageously prevented from scattering to the outside of the blade cover 21 from a very small gap between the lower edge of the blade cover 21 and the cutting object surface and the dust can be recovered with high accuracy.

Further, in the present embodiment, the pair of left and right circular-arc portions 33*a* are formed by one of the circular-arc portions at each of the two physically isolated slide guides 32, but it is also possible that the slide guide 32 be configured as a single element (for example, in a saddle-like shape) and that the pair of left and right circular-arc portions 33*a* rotatably holding the blade cover 21 be formed in this single slide guide 32.

Further, in the present embodiment, the pair of left and right linear portions 25*a* are formed by one of the linear portions at each of the two physically isolated sliders 25, but it is also possible that the slider 25 be configured as a single element and that the pair of left and right linear portions 25*a* sandwiching the circular-arc portions 33*a* be formed in this signal slider 25.

Further, the stoppers 26 are configured as individual components separate from the slider 25, but portions functioning as the stopper 26 can be also formed in part of the sliders 25. For example, a protrusion that protrudes inward from the upper end of the linear portion 25*a* may be formed and the pair of left and right linear portions 25*a* may be joined to each other at the upper end portion.

What is claimed is:

1. A cutting apparatus for concrete or the like, comprising:

a main body;

a blade cover; and a slide guide, wherein:

the main body includes a body frame, wheels, a motor, and a blade, and is configured so that a cutting depth of the blade during a cutting operation is adjustable by changing a tilting angle of the body frame in a front-rear direction and a height of a front portion of the body frame;

the blade cover includes a box-shaped casing having a size such that the blade can be entirely covered, and a slider attached to a rear surface of the casing;

the casing is open at a bottom surface side, and has a notch for receiving a rotating shaft of the blade formed in the rear surface of the casing from a lower edge upward to a predetermined height position;

the slider has left and right linear portions of a predetermined length and is attached so that both of the linear portions are oriented to be on an inner side and parallel to each other and also so that a predetermined gap is formed between a portion of a predetermined range including at least the linear portions and the rear surface of the casing;

the slide guide includes left and right circular-arc portions and flaps for sandwiching the linear portions of the slider;

the left and right circular-arc portions are disposed at a side surface of the body frame in a mutual arrangement so as to face one another in a front-rear direction of the body frame, with a rotating shaft that supports the blade being inserted therebetween;

each flap is attached so that a predetermined gap is formed between said flap and the side surface of the body frame; and by sandwiching the linear portions of the slider between the flaps of the slide guide and the body frame and sandwiching the circular-arc portions between the left and right linear portions, the blade cover is held in a state in which the blade cover can slide in the up-down direction with respect to the slide guide and the body frame and can rotate about the circular-arc portions.

2. The cutting apparatus for concrete or the like according to claim 1, wherein the left and right circular-arc portions are curved along a single virtual circle.

3. The cutting apparatus for concrete or the like according to claim 1, wherein the slider is attached to the rear surface of the casing, with a vibration-damping rubber bushing being interposed therebetween, and the entire slider is fixed at a position separated from the casing.

4. The cutting apparatus for concrete or the like according to claim 1, wherein an upper half of the blade cover is formed in a semicircular shape, and a base end portion of a dust flow channel formed inside the casing is open along an ejection direction of dust generated during the cutting operation.

5. The cutting apparatus for concrete or the like according to claim 1, wherein a dust guide is attached at a position such that part of the bottom surface of the blade cover is covered from below, so that a rear side can rotate, with a front side serving as a base point, and in a state such that the rear side is impelled downward.

6. The cutting apparatus for concrete or the like according to claim 1, wherein a stopper that restricts at a certain height position a downward movement of the blade cover attached to the slide guide is attached to the rear surface of the casing.

7. The cutting apparatus for concrete or the like according to claim 2, wherein the slider is attached to the rear surface of the casing, with a vibration-damping rubber bushing being interposed therebetween, and the entire slider is fixed at a position separated from the casing.

8. The cutting apparatus for concrete or the like according to claim 2, wherein an upper half of the blade cover is formed in a semicircular shape, and a base end portion of a dust flow channel formed inside the casing is open along an ejection direction of dust generated during the cutting operation.

9. The cutting apparatus for concrete or the like according to claim 3, wherein an upper half of the blade cover is formed in a semicircular shape, and a base end portion of a dust flow channel formed inside the casing is open along an ejection direction of dust generated during the cutting operation.

10. The cutting apparatus for concrete or the like according to claim 2, wherein a dust guide is attached at a position such that part of the bottom surface of the blade cover is covered from below, so that a rear side can rotate, with a front side serving as a base point, and in a state such that the rear side is impelled downward.

11. The cutting apparatus for concrete or the like according to claim 3, wherein a dust guide is attached at a position such that part of the bottom surface of the blade cover is covered from below, so that a rear side can rotate, with a front side serving as a base point, and in a state such that the rear side is impelled downward.

12. The cutting apparatus for concrete or the like according to claim 4, wherein a dust guide is attached at a position such that part of the bottom surface of the blade cover is covered from below, so that a rear side can rotate, with a front side serving as a base point, and in a state such that the rear side is impelled downward.

13. The cutting apparatus for concrete or the like according to claim 2, wherein a stopper that restricts at a certain height position a downward movement of the blade cover attached to the slide guide is attached to the rear surface of the casing.

14. The cutting apparatus for concrete or the like according to claim 3, wherein a stopper that restricts at a certain height position a downward movement of the blade cover attached to the slide guide is attached to the rear surface of the casing.

15. The cutting apparatus for concrete or the like according to claim 4, wherein a stopper that restricts at a certain height position a downward movement of the blade cover attached to the slide guide is attached to the rear surface of the casing.

* * * * *